US006516969B2

(12) United States Patent
Tamaoki

(10) Patent No.: US 6,516,969 B2
(45) Date of Patent: Feb. 11, 2003

(54) CHEMICAL FEEDING DEVICE

(75) Inventor: Yuichi Tamaoki, Ora-gun (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/926,337

(22) PCT Filed: Feb. 14, 2001

(86) PCT No.: PCT/JP01/01009

§ 371 (c)(1),
(2), (4) Date: Jan. 15, 2002

(87) PCT Pub. No.: WO01/60726

PCT Pub. Date: Aug. 23, 2001

(65) Prior Publication Data

US 2002/0134790 A1 Sep. 26, 2002

(30) Foreign Application Priority Data

Feb. 16, 2000 (JP) ..... 2000-038458

(51) Int. Cl.[7] ..... G07F 11/00
(52) U.S. Cl. ..... 221/2; 221/258
(58) Field of Search ..... 221/2, 3, 7, 9, 221/13, 82, 258, 277

(56) References Cited

FOREIGN PATENT DOCUMENTS

| | | |
|---|---|---|
| JP | 49-39172 | 4/1974 |
| JP | 06-008901 | 1/1994 |
| JP | 07-207570 | 8/1995 |
| JP | 08-191874 | 7/1996 |
| JP | 09-110177 | 4/1997 |
| JP | 2000-103404 | 4/2000 |

*Primary Examiner*—Kenneth W. Noland
(74) *Attorney, Agent, or Firm*—Armstrong, Westerman & Hattori, LLP

(57) ABSTRACT

The convenience of a medication supplying apparatus is improved. The medication supplying apparatus is equipped with a tablet case (1) having a dispensing drum for dispensing medications from an accommodating container that accommodates medications, a motor for driving the dispensing drum, a controlling means for controlling the operation of the motor, and a dispensing detection means for detecting the dispensing of a medication from the tablet case (1), wherein the controlling means reverses the motor if the dispensing detection means does not detect normal dispensing of a medication when the motor is rotated to dispense a medication.

10 Claims, 8 Drawing Sheets

CHEMICAL FEEDING DEVICE

TECHNICAL FIELD

The present invention relates to a medication supplying apparatus.

BACKGROUND ART

Conventionally, at hospitals or pharmacies, medications prescribed by doctors are supplied to patients by using a medication supplying apparatus (referred to as a "tablet packaging apparatus" in the publication) disclosed in, for example, Japanese Examined Utility Model Publication No. 575286 (B65B1/30).

The medications (tablets, capsules, etc.) in the quantities specified on prescriptions are dispensed one at a time from a dispensing drum (referred to as an "aligning board" in the publication) in the tablet case and collected by a hopper, then packaged.

A common object of the application concerned is to provide a preferred medication supplying apparatus with an improved medication supplying section in an automatic medication packaging machine, an automatic medication filling machine, an automatic dispensing machine, or the like.

A first object of the application concerned is to detect a fault while medication is being dispensed from a tablet case. A proposition regarding the detection of abnormal states has already been submitted by the present inventor under Japanese Patent Application No. 10-275656. In the application, however, a medication jam, which is an abnormal condition, is detected on the basis of the current passing through a motor. An object of the present application is to detect an abnormal condition by a simple construction.

A second object of the application concerned is to speed up the dispensing of medications from a tablet case. The dispensing of medications can be sped up by speeding up a dispensing drum. On the other hand, however, there is a danger in that making an attempt to simply achieve the speeding up will cause more medications than a target quantity to be dispensed due to a mechanical overrun. It could be possible to slow down the rotational speed. However, the sizes and shapes of medications are not the same, so that merely dropping down a motor output may cause a dispensing failure for some types of medications because of an insufficient motor output. The present invention is to provide a medication supplying apparatus that securely dispenses medications while restraining such an overrun.

A third object of the application concerned is to accurately count the number of dispensed medications. The dispensed medications are optically detected. Specifically, a detection optical path is formed by a light source (a light emitting means) and a sensor (a light receiving means). Dispensed medications interfere with the detection optical path, and the level of a light receiving signal from the sensor when a medication interfere with the detection optical path drops. Thus, the light receiving signal is compared with a threshold value thereby to detect the dispensed medication.

Different types of medications have different shapes, and the interfering cross-sectional areas thereof vary, depending on the orientations when they are dispensed, leading to significant variations in the drop in the light receiving level when they are dispensed. In addition, the sensor output falls because of contamination by powder from medications.

Hence, it is difficult to set the threshold value, and malfunction results unless the threshold value is set at an optimum value. The present invention is to provide a medication supplying apparatus that restrains malfunction.

DISCLOSURE OF INVENTION

According to the application concerned, there is provided a medication supplying apparatus equipped with a tablet case (1) having a dispensing drum for dispensing medications from an accommodating container that accommodates medications, a motor for driving the dispensing drum, a controlling means for controlling the operation of the motor, and a dispensing detection means for detecting the dispensing of a medication from the tablet case (1), wherein the controlling means reverses the motor if the dispensing detection means does not detect normal dispensing of a medication when the motor is rotated to dispense a medication.

Furthermore, according to the application concerned, the controlling means issues an anomaly alarm if the dispensing detection means does not detect normal dispensing of a medication even after a plurality of cycles of reversing the motor and then rotating it in the normal direction is repeated.

Furthermore, according to the application concerned, the controlling means stops the supply of power to the motor if the dispensing detection means does not detect normal dispensing of a medication even after a plurality of cycles of reversing the motor and then rotating it in the normal direction is repeated.

Furthermore, according to the application concerned, the controlling means determines that a medication has not been normally dispensed if the dispensing detection means does not detect the dispensing of the next medication for a predetermined time after having detected the dispensing of a medication.

In addition, according to the application concerned, there is provided a medication supplying apparatus equipped with a tablet case (1) having a dispensing drum for dispensing medications from an accommodating container that accommodates medications, a motor for driving the dispensing drum, a controlling means for controlling the operation of the motor, and a dispensing detection means for detecting the dispensing of a medication from the tablet case (1), wherein the controlling means counts the quantity of dispensed medications when a set target quantity of medications are dispensed, and when the count number reaches a value that is smaller than a target quantity by a predetermined value, it reduces the output of the motor to decrease the rotational speed thereof, then gradually increase the output of the motor from the moment the rotational speed is decreased.

Furthermore, according to the application concerned, the controlling means reduces the electric power supplied to the motor thereby to decrease the rotational speed of the motor.

Furthermore, according to the application concerned, the controlling means integrates the difference between a target quantity and a count number from the moment the electric power supplied to the motor is decreased, and the time integral amount of the difference is added to the motor output.

Furthermore, according to the application concerned, the controlling means stops the supply of power to the motor when a count number reaches a target quantity.

Furthermore, according to the application concerned, there is provided a medication supplying apparatus equipped with a tablet case (1) having a dispensing drum for dispensing medications from an accommodating container that accommodates medications, a motor for driving the dispensing drum, a light emitting means and a light receiving means that make up a detection optical path in a dispensing passage for medications from the tablet case (1), and a dispensing detection means for detecting the dispensing of a medication by comparing the level of a light receiving signal from the light receiving means with a threshold value, wherein the dispensing detection means corrects the threshold value according to the level of the light receiving signal obtained during a non-medication-dispensing period.

In addition, according to the application concerned, the non-dispensing period means the period before the operation for dispensing medications is started.

BEST MODE FOR CARRYING OUT THE INVENTION

Figure 1:
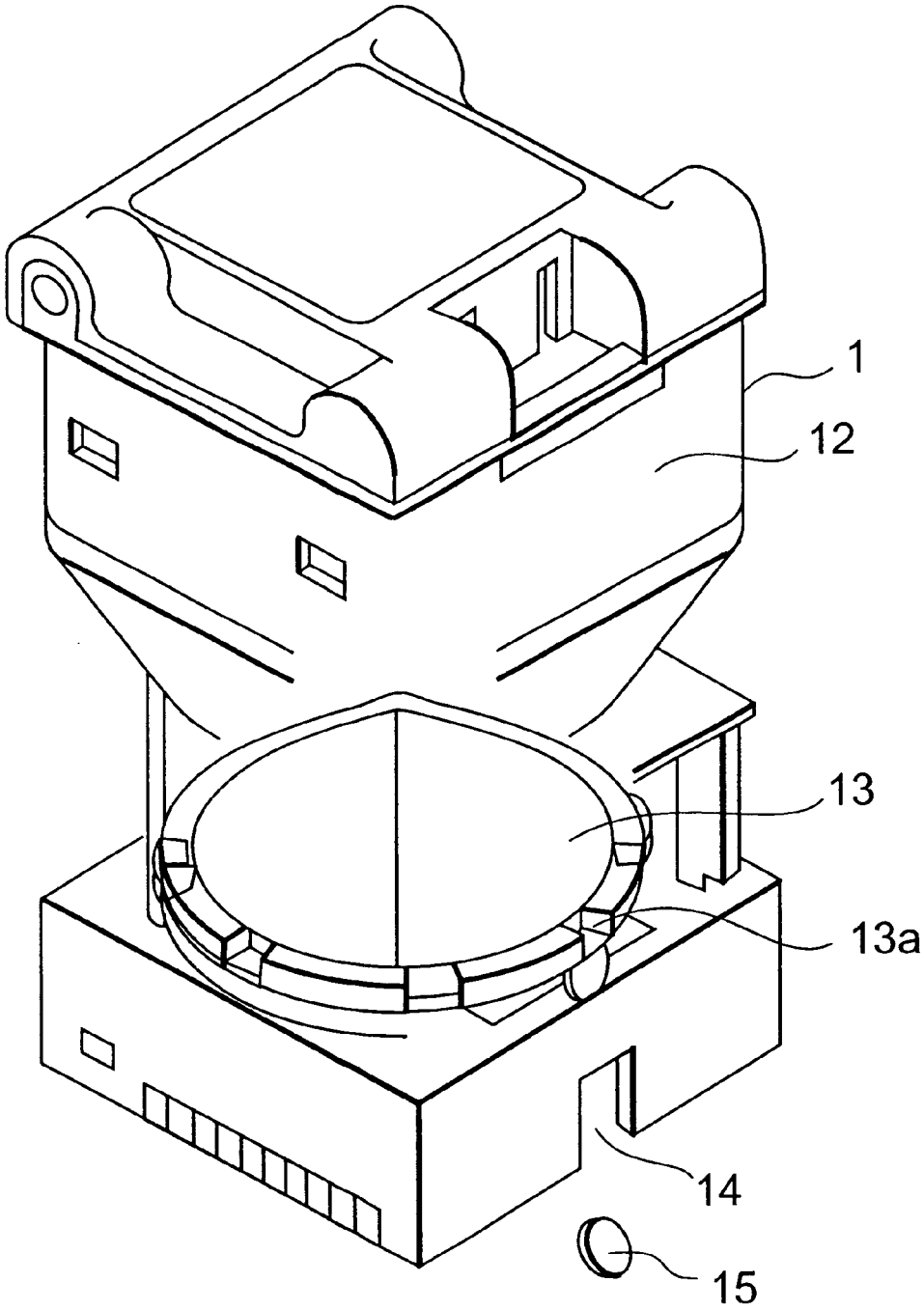
FIG. 1 is a diagram showing a tablet case of a first embodiment in accordance with the present invention.
Figure 2:
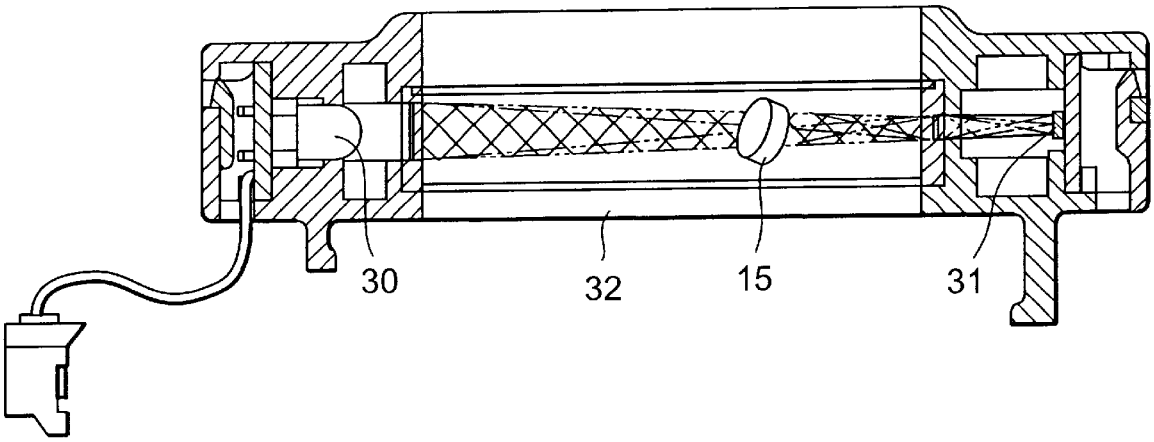
FIG. 2 is a diagram showing a dispensing detection optical path of the first embodiment.
Figure 3:
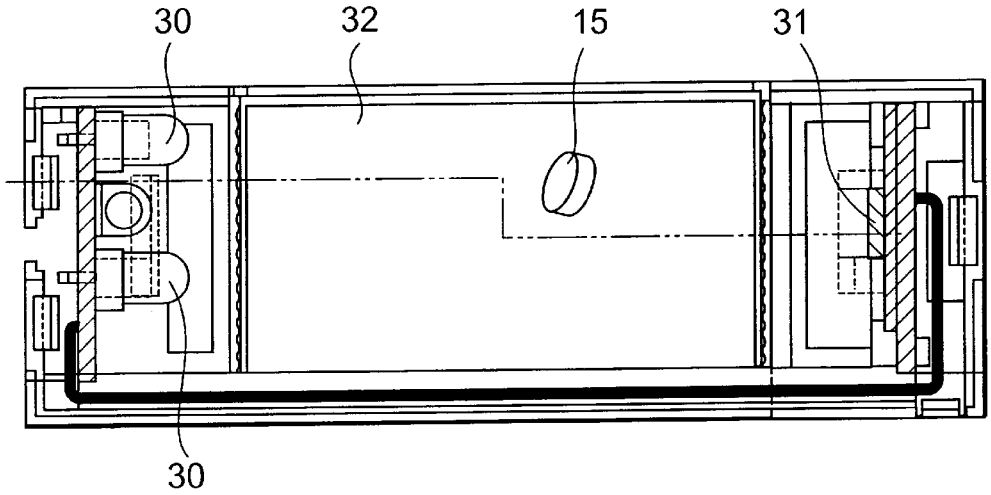
FIG. 3 is a diagram showing the dispensing detection optical path of the first embodiment.
Figure 4:
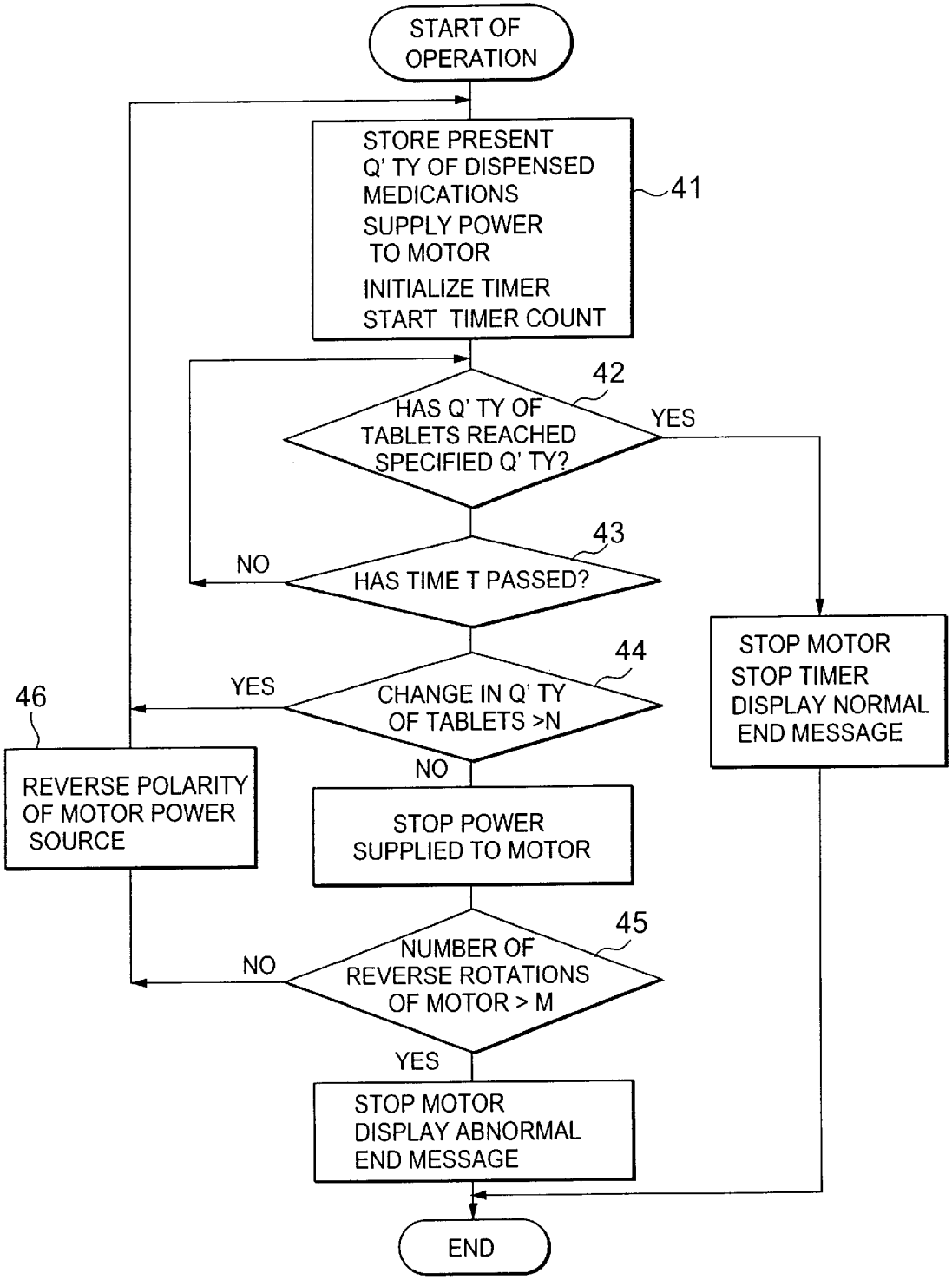
FIG. 4 is a flowchart for explaining an operation of the first embodiment.
Figure 5:
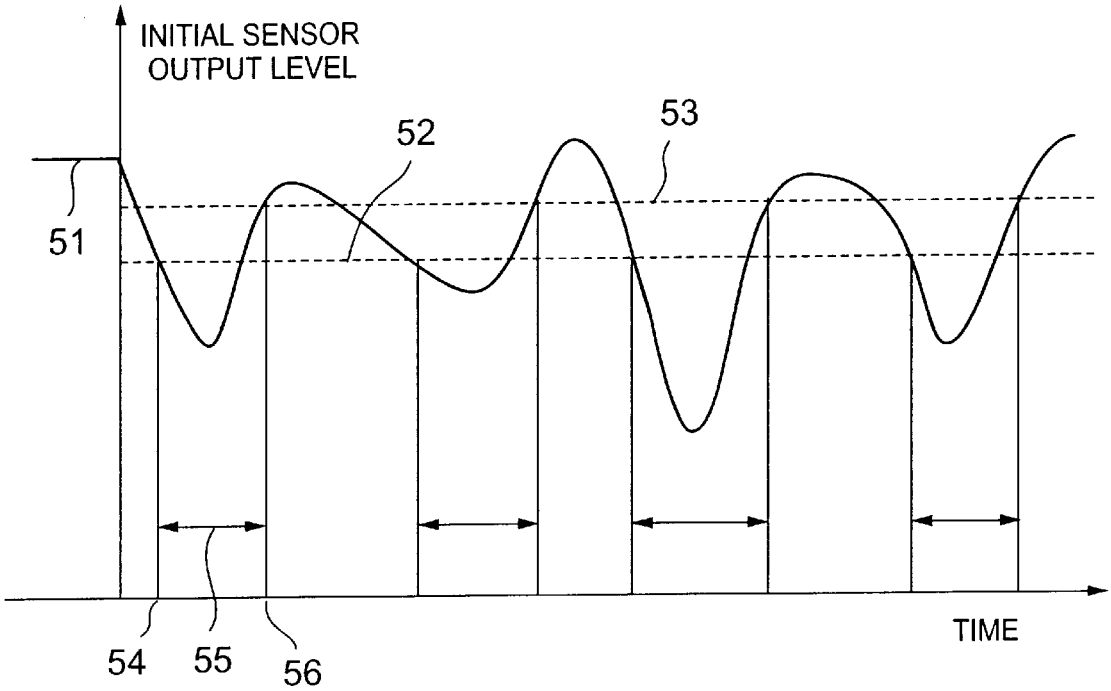
FIG. 5 is a diagram for explaining the fluctuation of a light receiving level in an early phase of the first embodiment.
Figure 6:
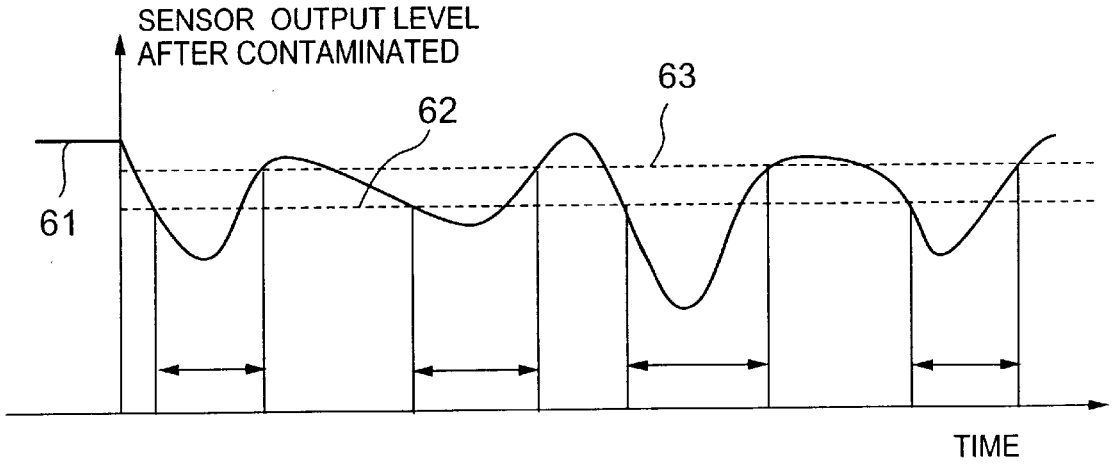
FIG. 6 is a diagram for explaining the fluctuation of the light receiving level observed when sensitivity deteriorates due to contamination or the like in the first embodiment.
Figure 7:
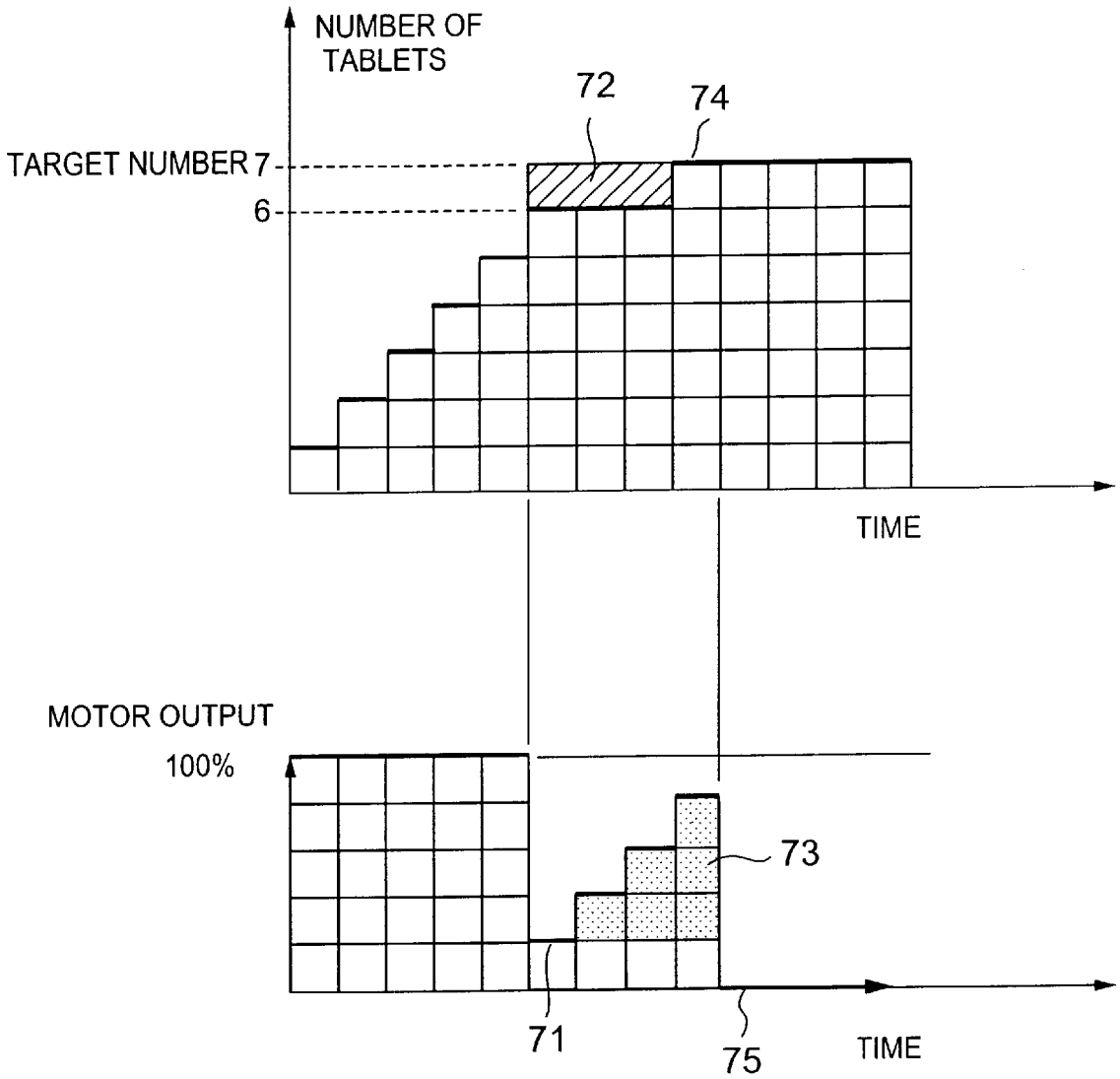
FIG. 7 is a diagram for explaining a situation where rotational speed is dropped before last dispensing, then a motor output is gradually increased in the first embodiment.
Figure 8:
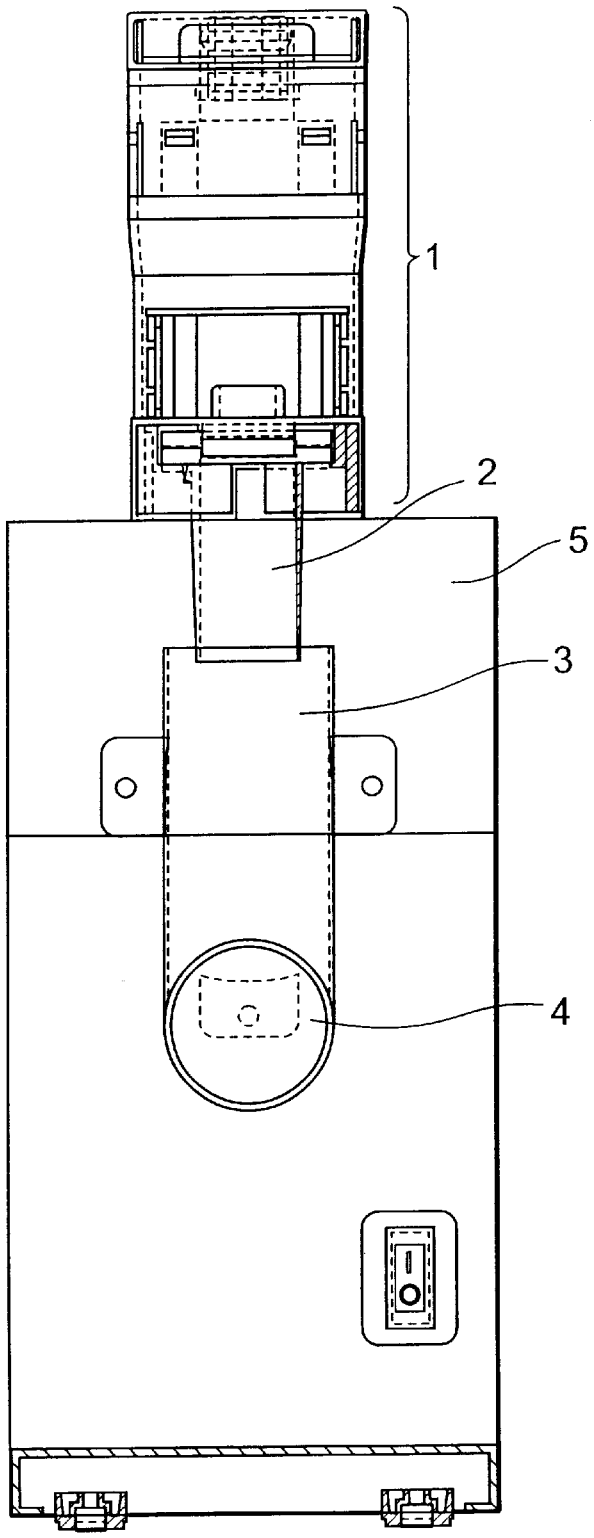
FIG. 8 is a front view of a medication filling apparatus according to the first embodiment.
Figure 9:
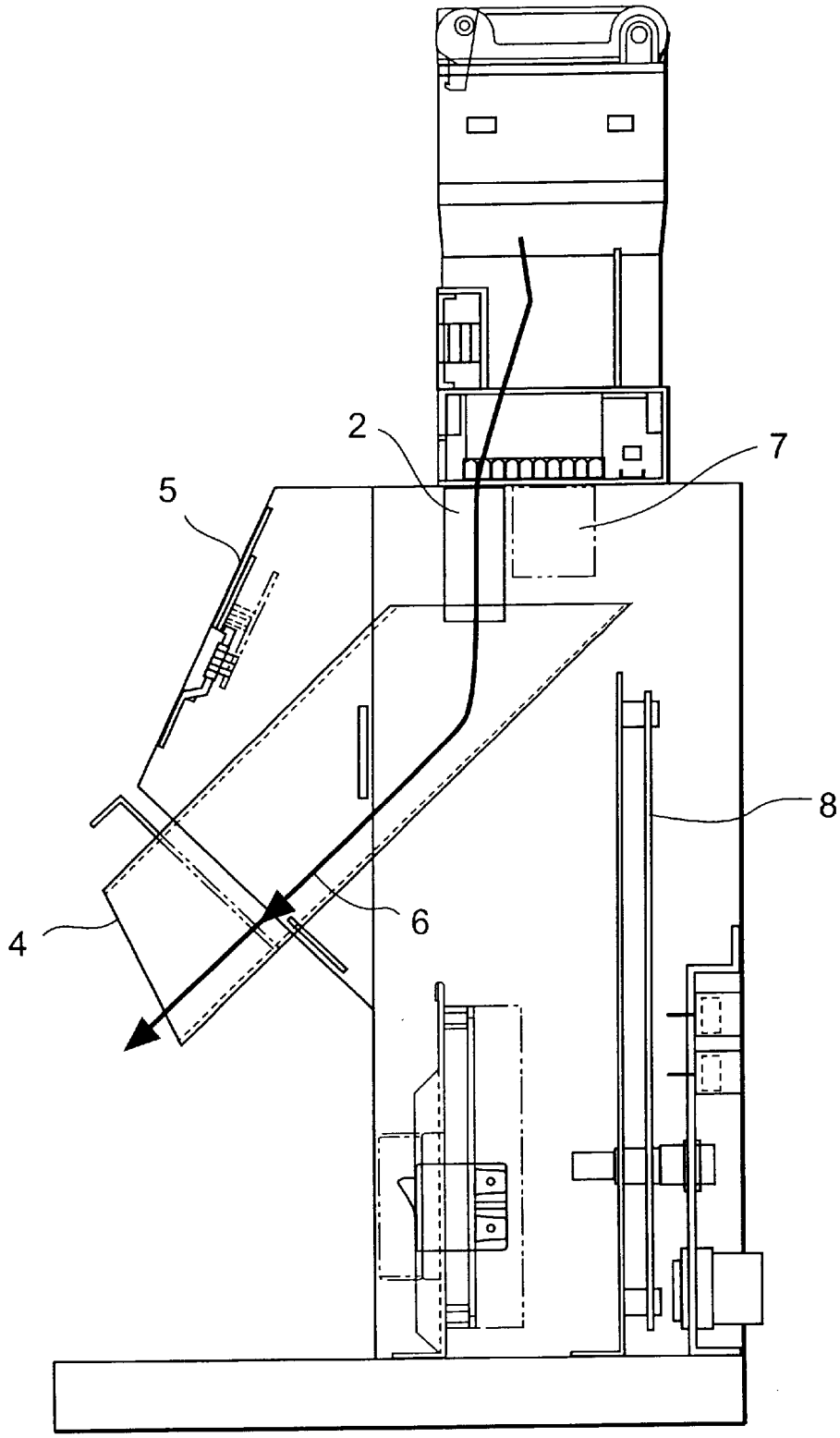
FIG. 9 is a side view of the medication filling apparatus according to the first embodiment.
Figure 10:
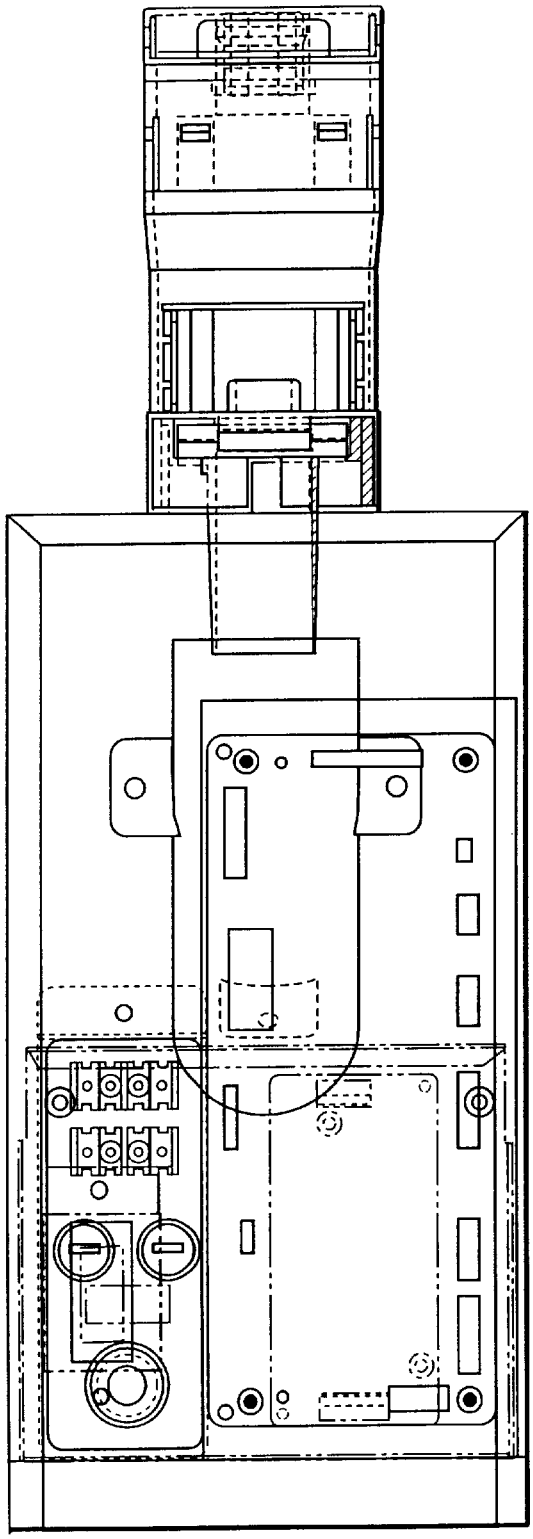
FIG. 10 is a rear view of the medication filling apparatus according to the first embodiment.

In conjunction with FIG. 1 through FIG. 10, a first embodiment according to the present invention will now be described in detail. FIG. 1 is a diagram showing a tablet case, in which a dispensing drum and medications are shown in a perspective manner. FIG. 2 is a diagram for explaining a dispensing detection optical path. FIG. 3 is also a diagram for explaining the dispensing detection optical path. FIG. 4 is a flowchart for explaining an operation. FIG. 5 is a diagram for explaining the fluctuation in a receiving light level in an early phase. FIG. 6 is a diagram for explaining the fluctuation in the light receiving level when sensitivity deteriorates due to contamination or the like. FIG. 7 is a diagram for explaining an operation in which rotational speed is reduced before last dispensing, then a motor output is gradually increased. FIG. 8, FIG. 9, and FIG. 10 are diagrams showing a medication filling apparatus, wherein FIG. 8 is a front view thereof, FIG. 9 is a side view thereof, and FIG. 10 is a rear view thereof.

A tablet case 1 includes a space for accommodating medications (tablets) and a well-known dispensing drum 13 for dispensing the medications.

The medications dispensed from the tablet case 1 pass through a passage 2, wherein an optical path for detecting dispensed medications is formed, and a chute 3, and moves as indicated by an arrow 6 of FIG. 9 from a chute outlet 4. By preparing a bottle or a tray under the chute outlet 4, the medications can be supplied into the bottle or the tray.

A substrate 5 makes up a control section for specifying a required number of medications (a target quantity) or for starting the dispensing from the tablet case, and a display section for displaying a target quantity and the number of dispensed medications, messages, etc.

A motor 7 drives the dispensing drum in the tablet case.

An instruction entered through a control section of the substrate 5 is processed by a control substrate section 8. The control substrate section 8 supplies electric power for running the motor 7 to the motor 7.

The tablet case 1 is shown in FIG. 1. A dispensing drum (aligning board) 13 rotates to align medications 15 and dispense them one at a time to an outlet 14. An accommodating section 12 provides a space for accommodating medications (tablets).

The medications 15 dispensed from the tablet case 1 pass through the passage 2 wherein an optical path for detecting dispensed medications shown in FIG. 9 is formed.

The optical path for detecting dispensed medications is shown in FIG. 2 and FIG. 3.

In FIG. 2 and FIG. 3, an infrared light emitting device 30 irradiates infrared rays toward a light receiving device 31. When a dispensed medication passes through a passage 32, the infrared beam is partially intercepted, resulting in a reduction in the quantity of light reaching the light receiving-device 31. Not all the light to be reaching the light receiving device 31 is blocked.

Hence, the output levels of the light receiving signals from the light receiving device 31 change in an analogue manner. The light receiving signals are output to the 10 control substrate section 8 of FIG. 9. The control substrate section 8 monitors the changes in the light receiving signal level so as to detect the passage (dispensing) of a medication and count the number of dispensed medications.

The operation of the control substrate section 8 will be explained with reference to FIG. 4 through FIG. 7.

First, an outline of the operation will be explained with reference to the flowchart of FIG. 4.

The control illustrated in FIG. 4 is begun upon receipt of a quantity of medications to be dispensed that is specified through the control section of the substrate 5 of FIG. 9 (specified quantity: specified number of pieces: target number) and a medication dispensing start command.

First, to perform comparative operation in step 41, the quantity of dispensed medications (the number of dispensed medications.) at the present point is stored. At the very beginning, the quantity is of course zero. The function of a timer is initiated as the motor is turned ON and run to dispense the medications.

Next, it is checked in step 42 whether the number the dispensed medications (tablets) has reached a specified quantity. If the specified quantity has not yet been reached, then the elapsed time on the timer that has been started is checked in step 43, and if a predetermined time T has not yet passed, then the program goes along a loop to return to step 42.

If it is determined in step 43 that the predetermined time T has passed, then a comparison is made to determine in step 44 whether the change in the quantity of tablets during the period T is a preset predetermined number N or more on the basis of the difference between the quantity of dispensed medications stored in step 41 and the present quantity of dispensed medications. If the determination result is NO, then the motor is stopped, and it is checked in step 45 whether the number of the reverse rotations of the motor is a preset number M or less. If it is M or less, then the program reverses the polarity of the power source of the motor in step 46, and returns to steps 41 and 42.

The dispensing drum 13 dispenses medications at shorter intervals when it is rotated at higher speed, while it dispenses medications at longer intervals when it is rotated at lower speed. During a normal operation, applying constant electric power to the motor 7 causes medications to be dispensed at substantially constant intervals. The values of N. M, and T mentioned above vary according to the amount of electric power supplied to the motor and the type of tablets.

In the present embodiment, the dispensing of medications is monitored to detect a failure.

If the dispensing drum is jammed with tablets, locking up the rotation of the dispensing drum, it is very likely that the jamming of the tablets can be removed by reversing the motor. When the number of remaining tablets becomes small, making it difficult for tablets to enter a cut 13*a* of the dispensing drum, reversing the motor makes it easier for the tablets to enter the cut. When tablets run out, if no dispensed tablet is detected after the reversing operation is repeated for an M number of times (e.g., 3 times), then an abnormal end message (alarm) is issued and the supply of electric power to the motor is stopped to terminate the operation.

Referring now to FIG. 7 that illustrates the changes in the motor output, the control of the rotational speed of the motor will be explained.

In this case, the target number (target quantity) of tablets to be dispensed is set to seven, and when the actual quantity of dispensed tablets reaches six, which is one less than the target number, the control substrate section drops the output of the motor to 20%, as indicated by 71. There is a difference of one piece in the target number and the actual number of dispensed tablets, as indicated by 72.

When the time integral amount of the difference is added to the motor output, the output gradually increases, as indicated by 73. When the last one piece is dispensed at 74, the motor output is reduced to 0% at 75 thereby to terminate the operation.

Thus, according to the application concerned, the rotational speed is reduced before last dispensing, and the motor output is also gradually increased. This is because merely dropping the motor output, on the other hand, may cause a dispensing failure due to an inadequate motor output; therefore, the output is gradually increased so as to enable secure dispensing even in the case of tablets requiring high load for dispensing.

The control of dispensing detection by the control substrate section 8 will now be explained by referring to FIG. 5 and FIG. 6.

FIG. 5 shows the detection in a clean-state.

Reference numeral 51 indicates a sensor output (a light receiving signal level) before the dispensing operation begins. Based on this value, a threshold value 52 and a threshold value 53 are calculated. In this embodiment, the threshold value 52 is defined as 80% of the output 51, and the threshold value 53 is defined as 90% of the output 51. When the output reduces below the threshold value 52, it is determined that the passage starts at 54, and when the output rises and exceeds the threshold value 53, it is determined that the passage completes at 56, thereby detecting a dispensed tablet. Reference numeral 55 indicates that the dispensed tablet is passing.

FIG. 6 illustrates the detection when the sensor has been contaminated. Reference numeral 61 indicates the sensor output (the light receiving signal level) before the dispensing operation begins. Based on this value, a threshold value 62 and a threshold value 63 are calculated.

In this embodiment, the threshold value 62 is defined as 80% of the output 61, and the threshold value 63 is defined as 90% of the output 61. When the output reduces below the threshold value 62, it is determined that the passage has started, and when the output rises and exceeds the threshold value 63, it is determined that the passage has completed, thereby detecting a dispensed tablet.

Thus, the threshold values are set at appropriate values according, to the sensor output.

Although the output reduces as a whole, the threshold value 62 and the threshold value 63 are derived on the basis of the sensor output 61 before the dispensing operation is begun. This will restrain malfunctions.

Industrial Applicability

According to the present invention, a preferred medication supplying apparatus can be provided.

What is claimed is:

1. A medication supplying apparatus comprising: a tablet case (1) having a dispensing drum for dispensing medications from an accommodating container that accommodates medications; a motor for driving the dispensing drum; controlling means for controlling the operation of the motor; and dispensing detection means for detecting the dispensing of a medication from the tablet case (1), wherein the controlling means reverses the motor if the dispensing detection means does not detect normal dispensing of a medication when the motor is rotated to dispense a medication.

2. A medication supplying apparatus according to claim 1, wherein the controlling means issues an anomaly alarm if the dispensing detection means does not detect normal dispensing of a medication even after a plurality of cycles of reversing the motor and then rotating it in the normal direction is repeated.

3. A medication supplying apparatus according to claim 1 or 2, wherein the controlling means stops the supply of power to the motor if the dispensing detection means does not detect normal dispensing of a medication even after a plurality of cycles of reversing the motor and then rotating it in the normal direction is repeated.

4. A medication supplying apparatus according to claim 1 or 2, wherein the controlling means determines that a medication has not been normally dispensed if the dispensing detection means does not detect dispensing of the next medication for a predetermined time after having detected the dispensing of a medication.

5. A medication supplying apparatus comprising: a tablet case (1) having a dispensing drum for dispensing medications from an accommodating container that accommodates medications; a motor for driving the dispensing drum; controlling means for controlling the operation of the motor; and a dispensing detection means for detecting the dispensing of a medication from the tablet case (1), wherein the controlling means counts the quantity of dispensed medications when a set target quantity of medications are dispensed, and when the count number reaches a value that is smaller than a target quantity by a predetermined value, it reduces the output of the motor to decrease the rotational speed thereof, then gradually increase the output of the motor from the moment the rotational speed was decreased.

6. A medication supplying apparatus according to claim 5, wherein the controlling means reduces the electric power supplied to the motor thereby to reduce the rotational speed of the motor.

7. A medication supplying apparatus according to claim 6, wherein the controlling means integrates the difference between the target quantity and the count number from the moment the electric power supplied to the motor is reduced, and the time integral amount of the difference is added to the motor output.

8. A medication supplying apparatus according to any one of claims 5 to 7, wherein the controlling means stops the supply of power to the motor when the count number reaches the target quantity.

9. A medication supplying apparatus comprising: a tablet case (1) having a dispensing drum for dispensing medications from an accommodating container that accommodates medications; a motor for driving the dispensing drum; a light emitting means and a light receiving means that make up a detection optical path in a dispensing passage for medications from the tablet case (1); and a dispensing detection means for detecting the dispensing of a medication by comparing the level of a light receiving signal from the light receiving means with a threshold value, wherein the dispensing detection means corrects the threshold value according to the level of the light receiving signal obtained during a non-medication-dispensing period.

10. A medication supplying apparatus according to claim 9, wherein the non-dispensing period means the period before the operation for dispensing medications is started.

* * * * *